US006167697B1

(12) United States Patent
Poggio et al.

(10) Patent No.: US 6,167,697 B1
(45) Date of Patent: Jan. 2, 2001

(54) DEVICE FOR CONTROLLING THE AIR/FUEL RATIO OF THE MIXTURE SUPPLIED TO AN ENDOTHERMAL ENGINE

(75) Inventors: Luca Poggio, Spinetta Marengo; Marco Violani, Florence; Marco Secco, Nizza Monferrato; Giovanni Gaviani, Rimini, all of (IT)

(73) Assignee: Magneti Marelli S.p.A., Milan (IT)

( * ) Notice: Under 35 U.S.C. 154(b), the term of this patent shall be extended for 0 days.

(21) Appl. No.: 09/354,843

(22) Filed: Jul. 16, 1999

(30) Foreign Application Priority Data

Jul. 16, 1998 (IT) ..... BO98A0437

(51) Int. Cl.[7] ..... F01N 3/00
(52) U.S. Cl. ..... 60/285; 60/274
(58) Field of Search ..... 60/285, 274

(56) References Cited

U.S. PATENT DOCUMENTS 3,827,237 * 8/1974 Linder et al. ..... 60/285
5,154,053 * 10/1992 Ishida et al. ..... 60/285
5,325,664 * 7/1994 Seki et al. ..... 60/285
5,335,493 * 8/1994 Uchida et al. ..... 60/285

* cited by examiner

*Primary Examiner*—Thomas Denion
*Assistant Examiner*—Thai-Ba Trieu
(74) *Attorney, Agent, or Firm*—Venable; Robert Kinberg

(57) ABSTRACT

A device for controlling the air/fuel ratio of the mixture supplied to an endothermal engine, in which a first and a second oxygen sensor disposed along an exhaust duct of the engine upstream and, respectively, downstream of a catalytic converter generate a first and respectively a second signal representative of the stoichiometric compositions of the combusted gases, the device having a first control circuit receiving as input the first signal and generating a correction parameter adapted to be applied to a quantity of fuel calculated in an open loop in order to obtain a corrected quantity of fuel for an injection unit of the engine, the device having a second control circuit which receives the second signal, supplies a correction signal to the first circuit in order to modify the correction parameter and has a control branch adapted to sample the second signal at a predetermined time frequency and to vary the correction signal when the difference between two successively sampled values is greater than a predetermined threshold so as to modify the air/fuel ratio and to minimise the time in which the catalytic converter operates at low efficiency.

15 Claims, 2 Drawing Sheets

Fig.2
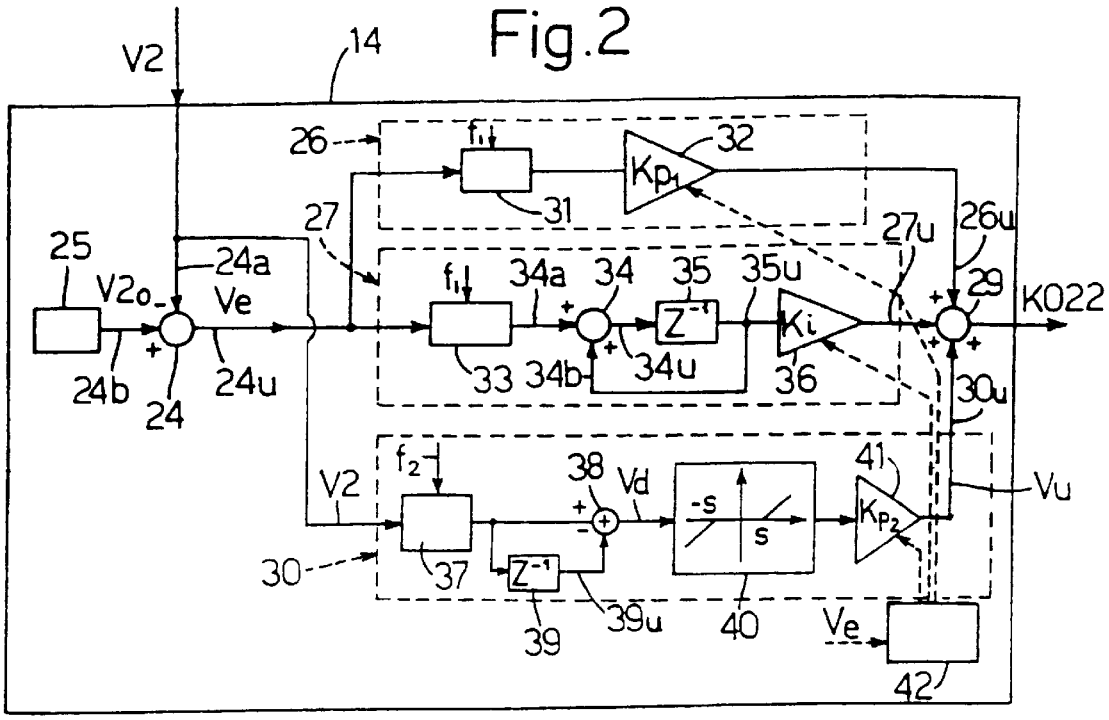
Fig.4
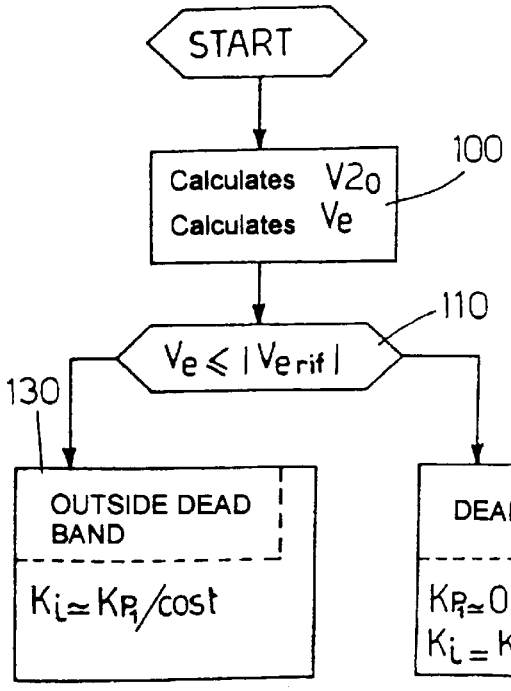
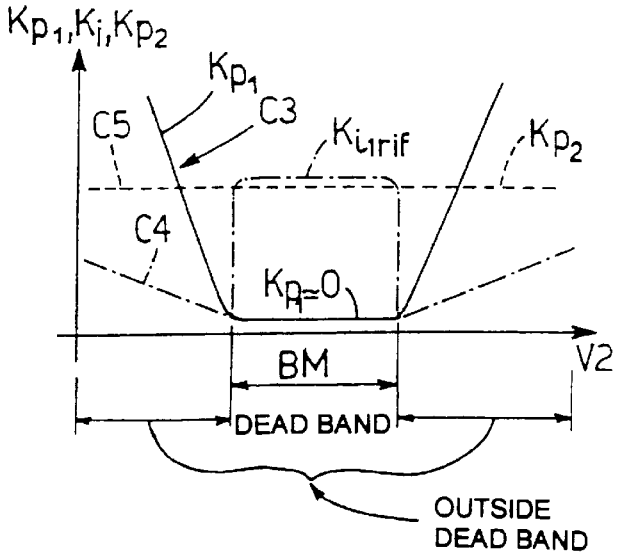
Fig.5

DEVICE FOR CONTROLLING THE AIR/FUEL RATIO OF THE MIXTURE SUPPLIED TO AN ENDOTHERMAL ENGINE

The present invention relates to an electronic control device for the air/fuel ratio of the mixture supplied to an endothermal engine.

The present invention is advantageously applied in the automobile field, to which the following description will refer without entering into detail.

BACKGROUND OF THE INVENTION

In the automobile field, it is known to use catalytic converters disposed along the exhaust duct for the combusted gases from an endothermal engine in order to remove the polluting substances contained in these gases. It is also known that the maximum efficiency of a catalytic converter, i.e. its ability optimally to remove these polluting substances, requires the air/fuel ratio of the mixture supplied to the engine to be kept close to the stoichiometric value, i.e. within a specific interval including this stoichiometric value.

In order to control the air/fuel ratio, use is made of electronic closed loop control devices in which a first oxygen sensor, disposed along the exhaust duct upstream of the catalytic converter, generates as output a feedback signal V1 indicating the stoichiometric composition of the exhaust gases and therefore of the air/fuel ratio of the mixture supplied to the engine. These devices supply the feedback signal V1 to a first control circuit which generates as output a correction parameter KO2 which is used to modify, in a closed loop, the value of a parameter calculated in an open loop and representative of a quantity of fuel to be injected into the engine cylinders.

These known devices, as a result of the reverse feedback of the signal V1, carry out a closed chain control intended to ensure that the air/fuel ratio is caused to oscillate about the stoichiometric value so as to enable the catalytic converter to remove the polluting substances in an optimum way. These devices have, however, certain drawbacks: in the first place they do not make it possible to carry out a diagnosis of the behaviour of the catalytic converter and secondly they are not able to carry out an appropriate control when there are drift errors in the chain including the first oxygen sensor.

In order to overcome these drawbacks, these control devices have been provided with a second oxygen sensor disposed along the exhaust duct downstream of the catalytic converter and a second control circuit connected to this second sensor and to the first control circuit. The second sensor in particular generates as output a feedback signal V2 indicating the stoichiometric composition of the exhaust gases introduced into the atmosphere, while the second control circuit, which has a proportional branch and an integral branch (P.I.), receives as input the signal V2 and is adapted to supply a correction signal K022 to the above-mentioned first control circuit. The correction signal KO22 is used by the first control circuit to modify the above-mentioned correction parameter KO22 by recovering the above-mentioned drifts. These devices tend to carry out a control action which maintains the exhaust titre (i.e. the air/fuel ratio measured by the second sensor and standardised to the stoichiometric value) within a predetermined interval of values in order to cause the catalytic converter to work at high efficiency.

Despite the fact that the introduction of the second sensor and the second control circuit has improved the control of the air/fuel ratio and made it possible to carry out diagnoses on the catalytic converter, the above-mentioned control devices have the drawback that they carry out a control action that is slow from the dynamic point of view.

These known devices respond very slowly to any departures of the exhaust titre from the interval of values corresponding to optimum operation of the catalytic converter and therefore require relatively long times to return the exhaust titre within this interval. This is particularly significant in situations immediately following "full load" and "cut-off" conditions, i.e. those conditions following a rapid acceleration or a release of the accelerator pedal.

Following these situations the air/fuel ratio diverges strongly from the stoichiometric value and the catalytic converter does not carry out correct removal of the polluting substances for the whole of the period that the control device requires to bring the exhaust titre back within the above-mentioned interval of values.

SUMMARY OF THE INVENTION

The object of the present invention is to provide a control device for the air/fuel ratio of the mixture supplied to an endothermal engine, which is free from the above-described drawbacks.

The present invention relates to a control device for the air/fuel ratio of the mixture supplied to an endothermal engine of the type described in claim 1.

The present invention also relates to a method of controlling the air/fuel ratio of the mixture supplied to an endothermal engine.

The present invention further relates to a method for controlling the air/fuel ratio of the mixture supplied to an endothermal engine of the type described in claim

BRIEF DESCRIPTION OF THE DRAWINGS

The present invention is described below with reference to the accompanying drawings, which show a non-limiting embodiment thereof, in which:

FIG. 2 is a diagram of a control circuit forming part of the device of FIG. 1;

FIG. 4 is a block diagram of the operations carried out by the control circuit of FIG. 2;

FIG. 5 shows the curves of some control parameters as a function of the output voltage of the sensor of on/off type of FIG. 3.

DETAILED DESCRIPTION OF THE INVENTION

Figure 1:
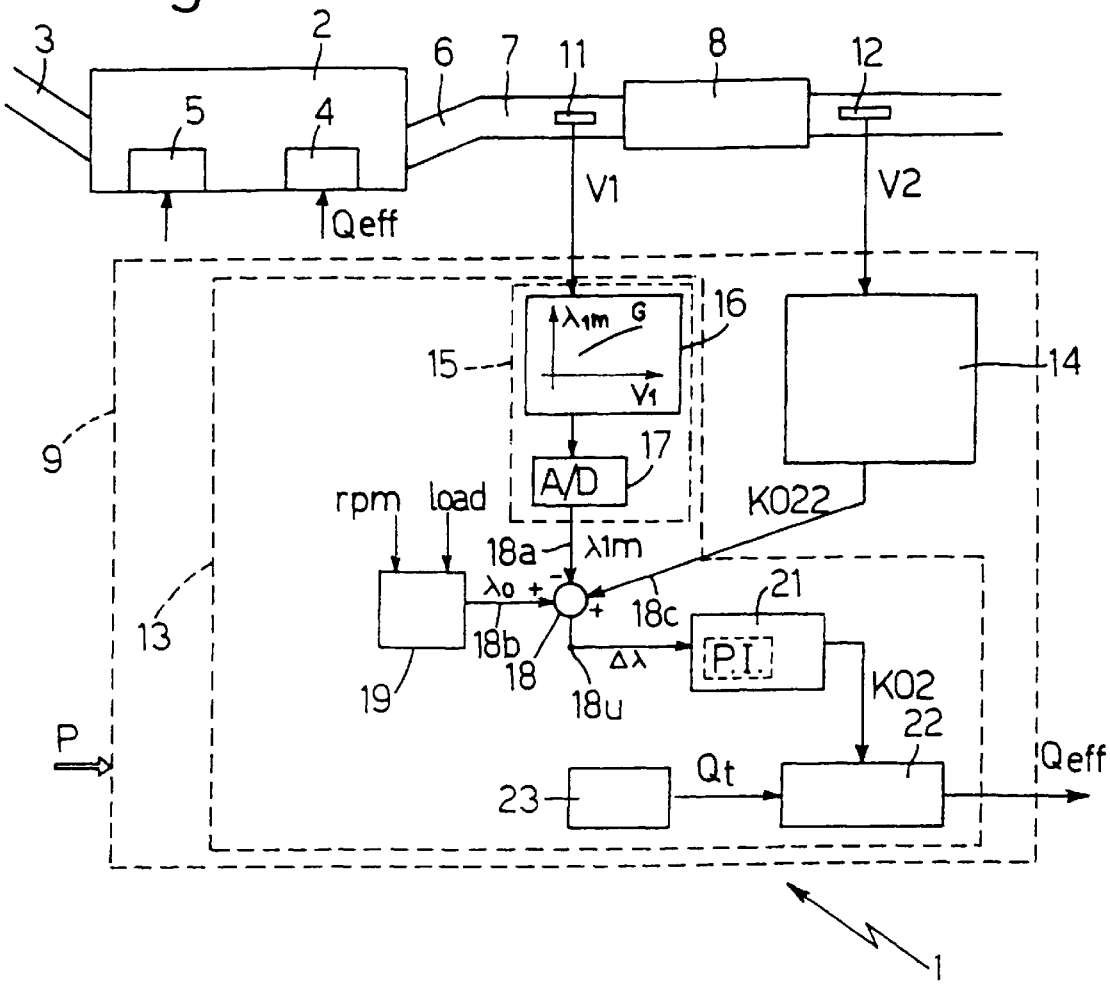
FIG. 1 is a diagram of an electronic control device for the air/fuel ratio of the mixture supplied to an endothermal engine of the present invention.

In FIG. 1, an electronic control device for the air/fuel ratio A/F of the mixture supplied to an endothermal engine 2, in particular a petrol engine (shown diagrammatically), is shown overall by 1.

The engine 2 has an intake manifold 3 for the supply of a flow of air to the cylinders (not shown) of the engine, a plant 4 for the injection of petrol into the cylinders, an ignition device 5 adapted to trigger combustion in the cylinders and an exhaust manifold 6 adapted to convey the combusted gases output from the engine. The output of the exhaust manifold 6 in particular communicates with a duct 7 for the discharge of the combusted gases along which there is disposed a catalytic converter 8 (of known type) adapted to remove the polluting substances contained in these gases.

The control device 1 comprises an electronic engine control unit 9 (shown diagrammatically in FIG. 1) adapted to control both the injection unit 4 in order to regulate the injection of fuel into the cylinders and the ignition device 5 in order to determine the instants at which combustion is triggered in the cylinders.

The unit 9 receives as input a plurality of information signals P measured in the engine 2 (for instance the number of revolutions per minute, the pressure in the intake manifold 4 and/or the air flow, the temperature of the engine cooling fluid, the air temperature, the butterfly valve position, etc.) together with information signals external to the engine (for instance the accelerator pedal position, signals from the vehicle gear change, etc.).

The control device 1 further comprises two oxygen sensors 11 and 12 which are disposed along the exhaust duct 7 upstream and respectively downstream of the catalytic converter 8 and cooperate with the unit 9 in order to supply information on the stoichiometric composition of the exhaust gases upstream and downstream of this converter 8. In particular, the sensor 11 is preferably of linear type (for instance formed by a UEGO probe) and is adapted to generate as output a feedback signal V1 indicating the composition of the exhaust gases upstream of the converter 8 and, therefore, correlated with the A/F ratio of the mixture supplied to the engine. The oxygen sensor 12, however, is preferably of on/off type (for instance formed by a LAMBDA probe) and generates as output a signal V2 indicating the stoichiometric composition of the gases introduced into the external atmosphere after the catalysing action of the converter 8.

The unit 9 comprises two feedback control circuits, shown by 13 and 14, of which the circuit 13 is connected to the sensor 11 in order to receive the signal V1 and is adapted to generate as output a parameter Qeff representative of the actual quantity of petrol (monitored in a closed chain) that the injection unit 4 needs to supply to the engine 2 during the engine cycle.

The control circuit 14, however, receives as input the signal V2 generated by the sensor 12 and supplies as output a digital correction signal KO22 to the circuit 13 in order to improve, as will be explained below, the feedback control of the A/F ratio carried out by this circuit 13.

In the control circuit 13, the output signal V1 from the sensor 11 is supplied to a conversion circuit 15 which is adapted to convert, in a known manner, this signal V1 into a parameter λ1m representative of the A/F ratio of the mixture supplied to the engine 2 and defined as:

$$\lambda 1m = \frac{(A/F)mis}{(A/F)stech}$$

in which (A/F)misrepresents the value of the air/petrol ratio measured by the sensor 11 and correlated with the signal V1 and (A/F)stech represents the value of the stoichiometric air/petrol ratio equivalent to 14.57. In particular, if the value of the parameter λ1m exceeds unity (λ1m>1) the A/F ratio measured is greater than the stoichiometric ratio, i.e. there is, overall, an insufficient quantity of petrol and the mixture supplied to the engine 2 is known as thin, whereas if the value of the parameter l1m is lower than unity (λ1m<1) the A/F ratio measured is lower than the stoichiometric ratio, i.e. there is, overall, an excessive quantity of fuel and the mixture supplied to the engine 2 is known as rich.

The conversion circuit 15 comprises two converters 16 and 17 disposed in series, of which the converter 16 is connected as input to the output of the sensor 11 in order to receive the signal V1 and is adapted to convert this signal V1 into the parameter λ1m by means of its own conversion characteristic C. The converter 17 is, however, an analog/digital converter which receives as input the parameter λ1m and is adapted to supply as output the digitised value of this parameter λ1m. The digitised parameter λ1m is supplied to a subtracting input 18*a* of a summing node 18 also having a summing input 18*b* to which the digital value of a parameter λo representative of an objective air/petrol ratio defined as:

$$\lambda o = \frac{(A/F)obiett}{(A/F)stech}$$

is supplied, in which (A/F)obiett represents the value of the objective air/fuel ratio which it is desired to achieve and (A/F)stech represents the value of the stoichiometric air/fuel ratio equivalent to 14.57.

The parameter λo is generated as output (in a known manner) by an electronic table 19 to which at least part of the information signals P (for instance the number of revolutions per minute (rpm), the load applied to the engine 2, etc.) are supplied as input. The node 18 therefore generates as output an error parameter Δλ given by the difference between the objective parameter λo and the parameter λ1m from the analog/digital converter 17, i.e.

$$\Delta\lambda = \lambda o - \lambda 1m$$

The node 18 has an output 18*u* connected to an input of a processing circuit 21, for instance a circuit adapted to carry out a conversion of the signal supplied as input in order to supply as output a correction parameter KO2. In the embodiment shown, the parameter KO2 is given by the proportional-integral processing P.I. of the error parameter Δλ; it is clear, however, that the closed loop correction parameter KO2 may be calculated by carrying out different operations on the error parameter Δλ and using more complex calculation algorithms than that illustrated.

The closed loop correction parameter KO2 is supplied as input to a correction circuit 22 which receives as input a parameter Qt representative of a quantity of fuel (calculated in an open loop) that the injection unit 4 should supply to the engine 2. The parameter Qt is calculated (in a known manner) in an open loop by means of an electronic table 23 receiving as input at least part of the information signals P.

The correction circuit 22 is adapted to apply the correction parameter KO2 to the parameter Qt in order to obtain as output the parameter Qeff representative of the actual quantity of fuel to be supplied to the engine. According to the embodiment shown, the parameter Qeff is calculated by multiplying the parameter Qt by the correction parameter KO2, i.e.:

$$Qeff = Qt * KO2$$

In the embodiment shown in FIG. 1, the control circuit 14, which receives as input the signal V2 from the sensor 12 disposed downstream of the catalytic converter 8, supplies the correction signal KO22 as output to a further summing input 18*c* of the node 18 in order to correct the error parameter Δλ depending on the composition of the exhaust gases actually introduced into the atmosphere, i.e.

$$\Delta\lambda = \lambda o - \lambda 1m + KO22$$

The sensor 12 and the control circuit 14 form a further control loop, external to the control loop comprising the sensor 11, which makes it possible to improve the overall control of the ratio A/F by recovering any drifts introduced into the control loop including this sensor 11.

With reference to FIG. 2, in the control circuit 14 the signal V2 output from the sensor 12 is supplied to a subtracting input 24*a* of a summing node 24 further comprising a summing input 24*b* to which a signal V2o indicating the objective switching voltage of the sensor 12 (LAMBDA probe), i.e. the voltage at which there is a transition of the exhaust titre from a state corresponding to a rich mixture to a state corresponding to a thin mixture or vice versa, is supplied. The signal V2o is generated as output (in a known manner) by a calculation circuit 25 receiving as input at least part of the information signals P such as the number of revolutions per minute (rpm) and the load.

The node 24 generates as output an error signal Ve given by the difference between the signal V2o and the output signal V2 of the LAMBDA probe, i.e. Ve=V2o−V2. The signal Ve is supplied to two processing branches shown by 26 and 27, of which the branch 26 is adapted to carry out a conversion of proportional type (P.) of the input signal, while the branch 27 is a branch of integrating type (I.). The two branches 26 and 27 have respective outputs 26*u* and 27*u* which are connected to respective summing inputs of a summing node 29 generating as output the correction signal KO22 to be supplied to the control circuit 13.

According to the present invention, the circuit 14 has a further processing branch 30 which receives as input the signal V2, has an output 30*u* connected to a further summing input of the node 29 and, as will be explained below, is adapted to ensure that the signal KO22 modifies the value of the error parameter Δλ (FIG. 1) in order to optimise the efficiency of the catalytic converter 8.

The branch 26 has a sampler 31 adapted to sample the error signal Ve at a frequency f1 connected to the number of revolutions per minute (rpm) of the engine: in particular, the sampler 31 is adapted to sample the signal Ve, for each combustion cycle of the engine, in the instants in which the angular position of the drive shaft is such that the various pistons are at their respective top dead centres. When output from the sampler 31, the signal Ve is supplied to a multiplier block 32 where it is firstly multiplied by a proportional control parameter $Kp_1$ and then supplied to the output 26*u*.

The integrating control branch 27 has a sampler 33 which is adapted to sample the error signal Ve at a frequency f1 (i.e. at the same instants during which the sampler 31 also samples) and supplies the sampled signal Ve to a summing input 34*a* of a summing node 34 which further comprises a second summing input 34*b* and an output 34*u* connected to a unitary delay block 35. The unitary delay block 35 has its own output 35*u*, which is connected in feedback to the input 34*b* and is connected to a multiplier block 36 adapted to apply an integrating control parameter Ki to the input value in order to supply it to the output 27*u*.

The control branch 30 has a sampler 37 which is adapted to sample the signal V2 at a predetermined frequency f2 which is independent from the angular position of the drive shaft and is generally much smaller than the frequency f1. The frequency f2 is defined within the following interval:

$$f2 \in \left[\frac{1}{5}f1, \frac{1}{3}f1\right]$$

While the samplers 31 and 33 therefore sample on the basis of the angular position of the drive shaft (each top dead centre), the sampler 37 carries out sampling on a predetermined time basis with a sampling period T (in the embodiment shown the period T is approximately 100 msec.). When output from the sampler 37, the sampled signal V2 is supplied both to a summing input of a summing node 38 and to a unitary delay block 39 which has its output 39*u* connected to a subtracting input of the node 38 in order to supply to this node 38 the last value of the signal V2 sampled prior to the current value. The summing node 38 is adapted to supply as output a parameter Vd given by the difference between the current value of the signal V2 and the value sampled prior to the current value, according to the expression:

$$Vd(t)=V2(t)-V2(t-T)$$

in which t is the current sampling instant and T is the sampling period of the sampler 37.

The output of the node 38 is connected to a filter block 40 which is adapted to supply as output the parameter Vd only when the relationship $$Vd>|s| \quad (1)$$

has occurred, in which S is a predetermined threshold value; vice versa, in the case in which the relationship (1) has not occurred, the block 40 supplies a zero value as output. In other words, the block 40 is adapted to supply as output the parameter Vd only when the signal V2 undergoes, in the time interval between two successive samplings, a significant variation that cannot be attributed solely to the presence of superimposed noise. In this way, the block 40 carries out a filtering action as regards any external noise or interference.

On output from the block 40, the parameter Vd is then supplied to a multiplier block 41 which is adapted to multiply this parameter Vd by a proportional control parameter $Kp_2$ before supplying it to the output 30*u*. In other words, the output 30*u* receives a signal Vu representative of a substantial variation of the signal V2 between two successive sampling instants of the sampler 37.

The control parameters $Kp_1$, $K_i$ and $Kp_2$ supplied respectively to the blocks 32, 36 and 41 are generated as output by a calculation circuit 42 whose operation will be described below.

The control device 1 implements a control strategy for the ratio A/F adapted to optimise the operation of the catalytic converter 8. The aim of this strategy is to minimise emissions of polluting substances into the atmosphere and, for this purpose, the control device 1 is adapted to control, cycle after cycle, the ratio A/F of the mixture to be supplied to the engine such that the catalytic converter 8 works as efficiently as possible to remove polluting substances. Before explaining this control strategy in detail, it should be noted that the sensor 12 (LAMBDA probe), by means of its output signal V2, informs the unit 9 about the operation of the catalytic converter 8 and, ultimately, about the condition of the exhaust titre Δ2m which, as is known, is defined by the relationship $$\lambda 2m = \frac{(A/F)mis}{(A/F)stech}$$

in which (A/F)mis represents the value of the air/petrol ratio measured by the sensor 12 and (A/F)stech represents the stoichiometric value equivalent to 14.57.

Figure 3:
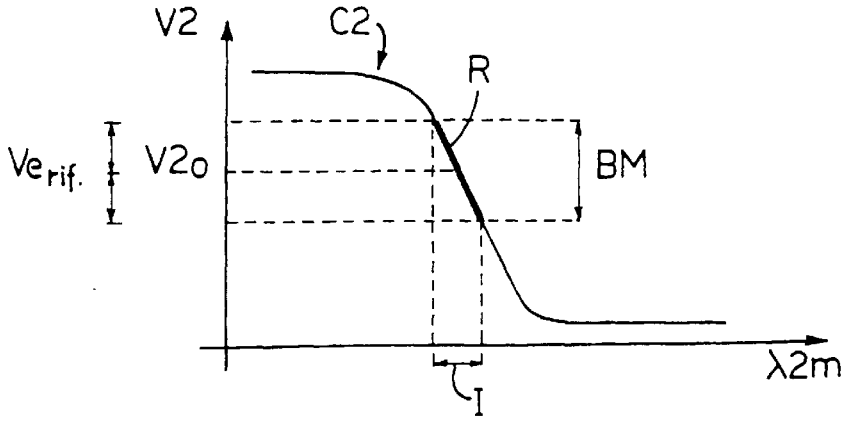
FIG. 3 shows the input-output characteristic of an oxygen sensor of on/off type forming a component of the device of FIG. 1.

FIG. 3 shows the transfer characteristic C2 of the sensor 12 (LAMBDA probe) which expresses the variation of the output signal V2 as a function of the exhaust titre λ2m. The objective of the control strategy is to enable the point of operation of the sensor 12 to remain as far as possible on a high-gradient section R of the characteristic C2 so that the sensor 12 can work as a linear oxygen sensor. In other words, the objective of the control device 1, and in particular the control circuit 14, is to ensure that the output signal V2 from the sensor 12 is maintained as far as possible within a dead band BM centred around the signal V2o indicating the objective switching voltage of this sensor 12, in order to ensure that the exhaust titre λ2m is kept in the interval I (FIG. 3) of maximum efficiency of the catalytic converter 8.

In order to understand the control strategy, the operation of the control circuit 14 will now be described.

With reference to FIG. 4, an initial block START leads to a block 100 in which the signal V2o (indicating the objective switching voltage of the sensor 12) is calculated, by means of the calculation circuit 25, as a function of the actual operating conditions of the engine, which are expressed for instance by the number of revolutions per minute (rpm) and by the load. The signal V2o is then compared with the output signal V2 from the sensor 12 by means of the summing node 24 which generates as output the error signal Ve representative of the divergence between the exhaust titre λ2m measured and the exhaust titre that it is desired to obtain in normal operating conditions of the engine. At the same time, the sampler 37 samples the signal V2 at a frequency f2 and the parameter Vd showing the difference between the values of the signal V2 at successive sampling instants is obtained as output from the node 38.

The output of the block 100 leads to a comparison block 110 in which the error signal Ve is compared with a reference value Verif (FIG. 3) in order to test whether this signal V2 is within the dead band BM, i.e. to ascertain whether the exhaust titre is within the interval I of maximum efficiency of the catalytic converter 8. The block 110 leads to a block 120 when the signal V2 is within the dead band BM (i.e. $Ve \leqq |Ve_{rif}|$), and to a block 130 when the signal V2 is outside the dead band BM (i.e. $Ve \leqq |Ve_{rif}|$).

The block 120 and the block 130 each define a respective control method for the exhaust titre λ2m. In the block 120 there is provided a control method for the titre λ2m called "dead band", according to which the control parameters $Kp_1$ and Ki are forced to assume values that enable the signal V2 to evolve over time performing oscillations about the signal V2o within the dead band BM. The control method forced in the block 130, however, is called "outside dead band", according to which the control parameters $Kp_1$ and Ki are forced to assume values enabling the signal V2 to evolve over time in order to return within the dead band BM.

In particular, according to the "dead band" control method, the control circuit 14 carries out a processing of the error signal Ve predominantly of integrating type (via the branch 27). At the same time, when the parameter Vd exceeds the threshold value S pointing to a sudden variation of the signal V2 likely to herald exit from the dead band BM, the branch 30 modifies the correction signal KO22 by means of the output of the block 41 such that the feedback control tends to cause this signal V2 to remain within the dead band BM.

In accordance, however, with the "outside dead band" control method, the circuit 14 carries out a processing of the signal Ve predominantly of proportional type (via the branch 26) so as to bring the signal V2 back within the dead band. At the same time, when the signal V2 tends to move away from the dead band BM and the parameter Vd exceeds the threshold value S, the branch 30 modifies the correction signal KO22 by means of the output of the block 41 so that the feedback control tends rapidly to bring the signal V2 back within the dead band BM.

With reference to FIG. 5, the calculation circuit 42 calculates the control parameters $Kp_1$, Ki and $Kp_2$ according to the characteristics C3, C4 and C5 shown in FIG. 5. In particular, on entry into the block 120 (dead band), the calculation circuit 42 calculates the parameters $Kp_1$ and Ki according to the expressions:

$$Kp_1 \equiv 0$$

$$Ki = Ki_{1rif}$$

in which Ki1rif is a predetermined reference value. It can be seen from this that the control action of the circuit 14 is chiefly due the branches 27 and 30. Vice versa, on entry into the block 130 (outside dead band) the proportional control parameter $Kp_1$ is obtained from the characteristic C3 shown in FIG. 5 as a function of the actual output signal V2 from the sensor 12, while the parameter Ki is calculated according to the expression $$Ki = Kp_1/Cost$$

in which Cost is a positive constant that can be calibrated that depends on the engine operating conditions. In this case, the control action of the circuit 14 is chiefly due to the branches 26 and 30 as can be seen from the curves of the characteristics C3, C4 and CS when the signal V2 is outside the dead band BM. It can be seen from FIG. 5 that the characteristic C3 which regulates the variation of the parameter $Kp_1$ as a function of the output signal V2 from the sensor 12 is substantially U-shaped and has two high-gradient sections R1 that are connected to a section R2 of almost zero gradient corresponding to the dead band BM and in which Kp1 is almost zero ($Kp_1 \equiv 0$).

In both control methods, the circuit 42 (FIG. 2) supplies the multiplier block 41 with the same value of the control parameter $Kp_2$ (the characteristic CS is constant with respect to the signal V2).

In this way, when the signal V2 is external to the dead band BM (block 130), the control circuit 14 acts (via the correction signal KO22) on the control circuit 13 such that the actual quantity of petrol to be supplied to the engine is such that the exhaust titre λ2m tends to return as rapidly as possibly within the interval I, i.e. the voltage V2 tends to return very rapidly within the dead band BM.

When, however, the output signal V2 from the LAMBDA probe is within the dead band BM (block 120), the proportional branch 26 does not make a significant contribution ($Kp_1 \equiv 0$) and the control circuit 14 acts on the circuit 13 (via the correction signal KO22) such that the exhaust titre λ2m remains as far as possible within the interval I, thereby optimising the operation of the catalytic converter 8.

The branch 30 carries out a processing of the error signal V2 that enables it to exert a feedback control action that speeds up the dynamic behaviour of the control device 1 with respect to known control devices. It is evident from the above description that the control device 1 responds very rapidly to any deviations of the exhaust titre from the interval I of values corresponding to the optimum operation of the catalytic converter 8, rapidly bringing the exhaust titre back within this interval I. The presence of the branch 30 in effect offsets the intrinsic delay of the catalytic converter 8 by anticipating the instant in which the exhaust titre returns within the interval I. This is particularly significant following "full load" and "cut-off" situations of the engine, i.e. in situations following a rapid acceleration or a release of the accelerator pedal. Following these situations, the exhaust titre diverges substantially from the stoichiometric value, and the control device 1 forces the exhaust titre rapidly to return within the interval of maximum efficiency of the catalytic converter 8, thereby minimising of polluting substances into the atmosphere.

What is claimed is:

1. A device (1) for controlling the air/fuel ratio of the mixture supplied to an endothermal engine (2), in which a catalytic converter (8) is disposed along an exhaust duct (7) for the combusted gases from this engine, the device (1) comprising a first (11) and a second (12) oxygen sensor which are disposed along the exhaust duct (7) upstream and respectively downstream of the catalytic converter (8) and are adapted to generate as output a first (V1) and a second (V2) signal indicating the stoichiometric composition of the exhaust gases, this device (1) comprising:

a first closed loop control circuit (13) which is adapted to receive as input this first signal (V1) and is adapted to calculate a correction parameter (KO2) adapted to be applied to a theoretical value (Qt) of a quantity of fuel calculated in an open loop in order to obtain a corrected quantity of petrol (Qeff) for a fuel injection unit (4) of the engine (2); and a second control circuit (14) which receives as input the second signal (V2) and is connected as output to the first control circuit (13) in order to supply a correction signal (KO22) adapted to modify the correction parameter (KO2);

the device (1) being characterised in that the second control circuit (14) comprises a first control branch (30) comprising:

first sampling means (37) adapted to sample the second signal (V2) at a predetermined first frequency (f2);

first processing means (38, 40, 41) cooperating with the first sampling means (37) in order to generate a first parameter (Vd) that is a function of the difference between the sampled values of the second signal (V2) at successive sampling instants, these first processing means (38, 40, 41) being adapted to process (41) the first parameter (Vd) in order to supply a first contribution (Vu) to the correction signal (KO22) and to ensure that the second signal (V2) tends rapidly to be brought and to remain in an interval of values (BM) corresponding to a zone of maximum efficiency of the catalytic converter (8).

2. A device as claimed in claim 1, characterised in that the first processing means (38, 40, 41) comprise:

first comparison means (38) which receive as input the sampled values (V2(t), V2(t−T)) of the second signal (v2) at two successive sampling instants (t, t−T) and are adapted to generate as output the first parameter (Vd) as a function of the difference between the sampled values (V2(t), V2(t−T)); and a processing block (41) receiving as input the first parameter (Vd) and adapted to apply a first proportional control parameter ($Kp_2$) in order to generate as output this first contribution (Vu) to the correction signal (KO22).

3. A device as claimed in claim 2, characterised in that the first control branch comprises filter means (40) which are interposed between the first comparison means (38) and the processing block (41) and are adapted to supply the first parameter (Vd) to the processing block (41) only if this first parameter (Vd) is in a predetermined relationship with a predetermined threshold value (S).

4. A device as claimed in claim 3, characterised in that the filter means (40) are adapted to supply the sampled error signal to the processing block (41) only when the following inequality has occurred:

$$|Vd| < S$$

in which (Vd) represents the first parameter and (S) is the predetermined threshold value.

5. A device as claimed in claim 1, characterised in that the first predetermined frequency (f2) is independent of the speed of rotation of the drive shaft.

6. A device as claimed in claim 1, characterised in that the second control circuit (14) comprises:

first setting means (25) receiving information signals (P) measured at least partially in the engine (2) and generating as output a reference signal (V2o) indicative of a desired stoichiometric composition of the exhaust gases downstream of the catalytic converter (8);

second comparison means (24) receiving the second signal (V2) and the reference signal (V2o) and adapted to generate as output an error signal (Ve) correlated with the difference between the second signal (V2) and the reference signal (V2o); and a second (26) and a third (27) control branch receiving as input the error signal (Ve) and adapted to supply as output a second and, respectively, a third contribution for the correction signal (KO22), the second control branch (26) being of proportional type and being adapted to process the error signal (Ve) with a second proportional control parameter ($Kp_1$), while the third control branch (27) is of the integrating type and is adapted to process the error signal (Ve) with an integrating control parameter (Ki).

7. A device as claimed in claim 6, characterised in that the second control branch (26) comprises second sampling means (31) in order to sample the error signal (Ve) at a second predetermined frequency (f1) that is a function of the speed of rotation of the drive shaft, and second processing means (32) connected to the second sampling means (31) in order to apply the proportional control parameter ($Kp_1$) to an output of these second sampling means (31) in order to supply the second contribution for the correction signal (KO22), the third control branch (27) comprising third sampling means (33) synchronous with the second sampling means (31) in order to sample the error signal (Ve), and third processing means (36) connected to the third sampling means (33) in order to carry out integrating processing using the integrating control parameter (Ki) in order to supply the third contribution for the correction signal (KO22).

8. A device as claimed in claim 7, characterised in that the second (31) and third (33) sampling means are adapted to sample the error signal (Ve) at the instants in which the pistons associated with the cylinders of the engine reach their respective top dead centres, the first sampling frequency (f2) being smaller than the second sampling frequency (f1).

9. A device as claimed in claim 7, characterised in that the second control circuit (14) comprises calculation means (42) adapted to calculate and to supply the first ($Kp_2$) and second ($Kp_1$) proportional control parameter and the integrating control parameter (Ki) to the first, second and third control branches (30, 26, 27), the control means (42) receiving as input the error signal (Ve) and being adapted to calculate the second proportional control parameter ($Kp_1$) and the integrating control parameter (Ki) as a function of this error signal (Ve).

10. A device as claimed in claim 9, characterised in that the calculation means (42) are adapted to calculate the second proportional control parameter ($Kp_1$) and the integrating control parameter (Ki) according to two alternative calculation methods (120, 130) on the basis of the value of the error signal (Ve), a first calculation method (120) being activated when the error signal (Ve) satisfies the following expression $$Ve \leqq |Ve_{rif}|$$

in which Ve and $Ve_{rif}$ respectively represent the error signal and a predetermined threshold value, a second calculation method (130) being activated when this expression is not satisfied, the first calculation method (120) representing the case in which the second signal (V2) is within the interval of values (BM) corresponding to a zone of maximum efficiency of the catalytic converter (8), while the second calculation method (130) represents the case in which the second signal (V2) is outside this interval of values (BM) and in that according to the first calculation method (120) the calculation means (42) supply values of the second proportional control parameter ($KP_1$) and the integrating control parameter (Ki) such that the second control circuit (14) processes the error signal (Ve) predominantly in an integrating manner and according to the second calculation method (130), the second proportional control parameter ($Kp_1$) and the integrating control parameter (Ki) assume values such that the second control circuit (14) processes the error signal (Ve) predominantly in a proportional way.

11. A device as claimed in claim 10, characterised in that the calculation means (42) are adapted to calculate the second proportional control parameter ($Kp_1$) as a function of the value of the second signal (V2) by means of a transfer characteristic (C3) having a substantially U-shaped curve with a central portion (R2) having a low gradient and two side portions (R1) having a high gradient, the second proportional control parameter ($Kp_1$) assuming a substantially zero value at the location of the central portion (R2), the central portion (R2) corresponding to the first calculation method (120) and the lateral portions (R1) corresponding to the second calculation method (130).

12. A device as claimed in claim 1, characterised in that the first control circuit (13) comprises:

converter means (16, 17) receiving the first signal (V1) output from the first oxygen sensor (11) and adapted to generate as output a measured parameter (λ1 m) representative of the air/fuel ratio of the mixture supplied to the engine (2);

second setting means (19) receiving as input the information signals (P) and generating as output an objective parameter (λo) representative of a desired air/fuel ratio;

fourth processing means (18) receiving as input this objective parameter (λo) and the measured parameter (λ1 m) and adapted to generate an error parameter (Δλ) correlated with the difference between the objective parameter (λo) and the measured parameter (λ1 m), these fourth processing means (18) receiving the correction signal (KO22) from the second control circuit (14) in order to modify the error parameter (Δλ); and fifth processing means (21) receiving as input the modified error parameter and adapted to calculate the correction parameters (KO2) to be applied to the theoretical value (Qt) of a quantity of fuel calculated in an open loop in order to obtain the corrected quantity of fuel (Qeff) for the fuel injection unit (4).

13. A method for controlling the air/fuel ratio of the mixture supplied to an endothermal engine (2), in which a catalytic converter (8) is disposed along an exhaust duct (7) for the combusted gases from this engine (2), comprising the stages of:

generating as output a first signal (V1) by means of a first oxygen sensor (11) disposed along the exhaust duct (7) upstream of the catalytic converter (8);

generating as output a second signal (V2) by means of a second oxygen sensor (12) disposed along the exhaust duct (7) downstream of the catalytic converter (8);

processing (13) of the first signal (V1) in order to calculate a correction parameter (KO2) adapted to be applied to a theoretical value (Qt) of a quantity of fuel calculated in an open loop in order to obtain a corrected quantity of petrol (Qeff) for a fuel injection unit (4) of the engine (2);

processing (14) of the second signal (V2) in order to generate a correction signal (KO22) adapted to modify this correction parameter (KO2);

characterised in that the stage of processing (14) of the second signal (V2) comprises the stages of:

sampling (37) the second signal (V2) at a first predetermined frequency (f2);

generating a first parameter (Vd) as a function of the difference between the sampled values of the second signal (V2) at successive sampling instants; and processing (41) of the first parameter (Vd) in order to supply a first contribution (Vu) to the correction signal (KO22) ensuring that the second signal (V2) tends rapidly to be brought and to remain within an interval of values (BM) corresponding to a zone of maximum efficiency of the catalytic converter (8).

14. A method as claimed in claim 13, characterised in that the stage of processing (14) of the second signal (V2) comprises the stages of:

applying (30) at least one proportional processing to the first parameter (Vd) by means of a first proportional control parameter ($Kp_2$);

setting (25), on the basis of information signals (P) measured at least partially in the engine (2), of a reference signal (V2o) indicative of a desired stoichiometric composition of the exhaust gases downstream of the catalytic converter (8);

comparing (24) the second signal (V2) with the reference signal (V2o) in order to generate an error signal (Ve) correlated with the difference between the second signal (V2) and the reference signal (V2o);

applying (26) a processing of proportional type to the second error signal (Ve) by means of a second proportional control parameter ($Kp_1$), in order to provide a second contribution for the correction signal (KO22); and applying (27) an integrating processing to the error signal (Ve), by means of an integrating control parameter (Ki), in order to supply a third contribution for this correction signal (KO22).

15. A method as claimed in claim 14, characterised in that it further comprises the stage of calculating (42) the second proportional control parameter ($Kp_1$) and the integrating control parameter (Ki) according to two alternative calculation methods (120, 130) on the basis of the value of the error signal (Ve);

a first calculation method (120) being activated when the error signal (Ve) satisfies the following expression:

$$Ve \leq |Ve_{rif}|$$

in which (Ve) and ($Ve_{rif}$) respectively represent the error signal and the predetermined threshold value, a second calculation method (130) being activated when this expression is not satisfied, the first calculation method (120) representing the case in which the second signal (V2) is within the interval of values (BM) corresponding to a zone of maximum efficiency of the catalytic converter (8), while the second calculation method (130) represents the case in which the second signal (V2) is outside this interval of values (BM) and in that according to the first calculation method (120) the second proportional control parameter ($Kp_1$) and the integrating control parameter (Ki) assume values such that the processing of the error signal (Ve) is predominantly of the integrating type and in that according to the second method of calculation (130), the second proportional control parameter ($Kp_1$) and the integrating control parameter (Ki) assume values such that the processing of the error signal (Ve) is predominantly of proportional type.

* * * * *